US005629718A

United States Patent [19]

Surguy

[11] Patent Number: 5,629,718

[45] Date of Patent: May 13, 1997

[54] ADDRESSING A MATRIX-TYPE LIQUID CRYSTAL CELL

[75] Inventor: Paul W. H. Surguy, Hayes, England

[73] Assignee: Central Research Laboratories Limited, Middlesex, England

[21] Appl. No.: 397,177

[22] PCT Filed: Oct. 4, 1993

[86] PCT No.: PCT/GB93/02056

§ 371 Date: Mar. 8, 1995

§ 102(e) Date: Mar. 8, 1995

[87] PCT Pub. No.: WO94/08329

PCT Pub. Date: Apr. 14, 1994

[30] Foreign Application Priority Data

Oct. 3, 1992 [GB] United Kingdom ..... 9220836

[51] Int. Cl.[6] ..... G09G 3/36

[52] U.S. Cl. ..... 345/99; 345/94; 345/97

[58] Field of Search ..... 345/94, 95, 96, 345/97, 98, 99, 87

[56] References Cited

U.S. PATENT DOCUMENTS 5,091,723 2/1992 Kanno et al. ..... 345/97

5,264,839 11/1993 Kanno et al. ..... 345/98

FOREIGN PATENT DOCUMENTS 0316774 5/1989 European Pat. Off. .

0406705 1/1991 European Pat. Off. .

*Primary Examiner*—Steven Saras

*Assistant Examiner*—Kent Chang

*Attorney, Agent, or Firm*—Keck, Mahin & Cate

[57] ABSTRACT

A liquid crystal cell comprising a matrix of pixels defined by areas of overlap between members of first and second sets of orthogonal electrodes has its pixels selectively set to first and second states by addressing the pixels in rows. The pixels a given row are first set no a first state by applying an erase signal (12) to the corresponding row conductor simultaneously with applying bipolar data signals (8, 9) to all the column conductors. Selected pixels of the row are subsequently set to a second state by applying a strobe signal (10) to the row conductor simultaneously with applying a bipolar data signal(9) to the relevant column conductors, another bipolar data signal (8) being applied to the column conductors corresponding to non-selected pixels. The start of the strobe signal coincides with the start of the active central portion of the data signals but the strobe signal continues beyond the end of this portion, enabling the addressing rate to be increased. (FIG. 2)

7 Claims, 3 Drawing Sheets

ADDRESSING A MATRIX-TYPE LIQUID CRYSTAL CELL

This invention relates to a method of addressing a matrix-type liquid crystal cell including liquid crystal material which is electrically settable to first and second stable optical states, the cell comprising a plurality of pixels which are defined by areas of overlap between members of a first set of electrodes on one side of the material and members of a second set of electrodes, which cross the first set, on the other side of the material, in which method the pixels are addressed in lines, the addressing of each line comprising (a) applying an erase signal having a given polarity to the corresponding electrode of the first set while applying at least one charge-balanced bipolar data signal to each electrode of the second set, thereby setting any pixel of the line which is not already in the first state to that state, and (b) subsequently applying a strobe signal having an opposite polarity to said given polarity to the corresponding electrode of the first set while applying a charge-balanced bipolar data signal to each electrode of the second set, thereby selectively setting to the second state any pixel of the line for which the data signal applied to the corresponding electrode of the second set has a given form. The invention also relates to optical modulator apparatus for implementing such a method.

A known such method is disclosed in GB-A-214473. In this known method, the data signal comprises first and second successive portions of opposite polarities. When the data signal has the given form the strobe signal coincides with that one of these portions which has the given polarity, so that the magnitude of the signal applied across the corresponding pixel is the sum of the magnitudes of the strobe and data signals. GB-A-214473also discloses an addressing method in which the data signal comprises first, second and third portions, the polarity of the second portion being opposite to that of the first and third portions. In this last method the strobe signal coincides with the second portion of the data signal and is bipolar, making it unnecessary to employ an erase signal to ensure that all pixels of a line are initially in the first state. In both these known methods the product of the time for which the data signal has one polarity and its amplitude when it has this polarity is equal to the product of the time for which it has the other polarity and its amplitude when it has this other polarity. The data signal is therefore balanced; in itself it has no net effect on any given pixel.

The maximum addressing speed when using such methods is limited by the length of the erase signal (if present) and the length of the strobe signal; each has to be present for a sufficient time to ensure that the relevant pixels are actually set to the first and second states respectively, this process taking a finite time. When the first of the known methods referred to above is used, the length of the strobe signal is equal to the length of one of the two (equal-length) portions of the data signal i.e. to half the length of the complete data signal, and when the second of these known methods is used the length of the active portion of the strobe signal is equal to half the length of the second portion of the data signal, which corresponds to one quarter of the length of the complete data signal.

It is an object of the invention to allow the minimum length of a complete data signal in a method as defined in the opening paragraph to be reduced, thereby increasing the maximum permissible addressing speed.

According to one aspect the invention provides a method as defined in the first paragraph which is characterised in that when said data signal has said given form it comprises first, second and third successive portions in which it has said given polarity, said opposite polarity and said given polarity respectively, the amplitude of the second portion being less than the amplitude of the strobe signal, the end of the first portion coinciding with or occurring before the start of the strobe signal, the end of the second portion occurring after the start of the strobe signal, and the start of the third portion occurring before the end of the strobe signal.

It has been found that, if the data signal of the given form has first, second and third successive portions which are respectively of an opposite polarity to, the same polarity as, and an opposite polarity to the strobe signal, and the amplitude of the second portion is less than that of the strobe signal, then it can be beneficial in respect of the setting to the second state if the strobe signal continues into the period occupied by the third portion of the data signal. The co-operation of the strobe signal with at least part of the third portion of the data signal can assist the setting effect of the co-operation of the strobe signal with at least part of the second portion of the data signal, thereby enabling the time for which it is necessary that the strobe signal co-operates with the second portion of the data signal, and hence the minimum actual duration of the second portion of the data signal, to be reduced.

According to another aspect the invention provides optical modulator apparatus comprising a matrix-type liquid crystal cell and an addressing signal generator for addressing said cell, the cell including liquid crystal material which is electrically settable to first and second stable optical states, and comprising a plurality of pixels which are defined by areas of overlap between members of a first set of electrodes on one side of the material and members of a second set of electrodes, which cross the first set, on the other side of the material, the addressing signal generator having outputs coupled to the first and second sets of electrodes and being contructed to address the pixels in lines by each time (a) applying an erase signal having a given polarity to the corresponding electrode of the first set while applying at least one charge-balanced bipolar data signal to each electrode of the second set, thereby setting any pixel of the line which is not already in the first state to that state, and (b) subsequently applying a strobe signal having an opposite polarity to said given polarity to the corresponding electrode of the first set while applying a charge-balanced bipolar data signal to each electrode of the second set, thereby selectively setting to the second state any pixel of the line for which the data signal applied to the corresponding electrode of the second set has a given form, characterised in that the generator is constructed so that when said data signal has said given form it comprises first, second and third successive portions in which it has said given polarity, said opposite polarity and said given polarity respectively, the amplitude of the second portion being less than the amplitude of the strobe signal, the end of the first portion coinciding with or occurring before the start of the strobe signal, the end of the second portion occurring after the start of the strobe signal, and the start of the third portion occurring before the end of the strobe signal.

Embodiments of the invention will now be described, by way of example, with reference to the accompanying diagrammatic drawings in which FIG. 1 shows optical modulator apparatus comprising a liquid crystal cell and an address signal generator therefor;

Figure 1:
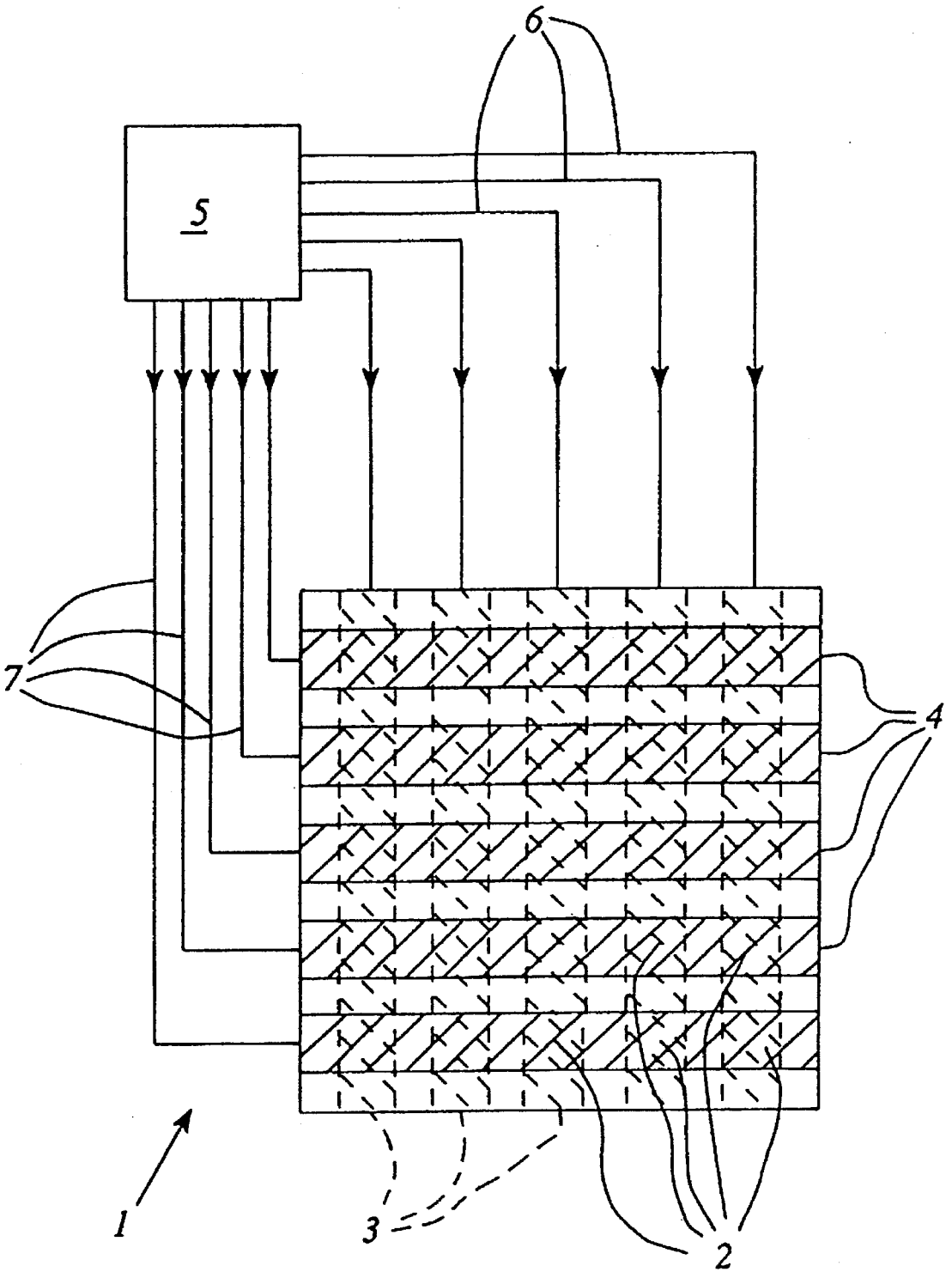

In FIG. 1 a matrix-type liquid crystal cell 1 comprises in known manner a pair of transparent plates which are superimposed one upon the other with a small spacing therebetween which contains ferroelectric liquid crystal material. The cell comprises a plurality of picture elements (pixels) which are defined by areas 2 of overlap between members of a first set of parallel transparent electrodes 4 provided on the inner surface of one plate, i.e. on one side of the liquid crystal material, and members of a second set of parallel transparent electrodes 3 provided on the inner surface of the other plate, i.e. on the other side of the liquid crystal material. The electrodes 3 and the electrodes 4 cross each other and in the present example are oriented substantially orthogonal to each other and each corresponds to a respective line of pixels. (With the orientation shown each electrode 3 corresponds to a respective column of pixels and each electrode 4 corresponds to a respective row).

The cell 1 is addressed by means of an addressing signal generator 5 via conductors which are connected to respective electrodes 3 and conductors 7 which are connected to respective electrodes 4. For each pixel the resulting electric field applied there across determines the alignment of the liquid crystal molecules and hence the optical state of that pixel. The cell 1 is positioned between parallel or crossed polarizers (not shown). The orientation of the polarizers relative to the alignment of the liquid crystal molecules determines whether or not light can pass through a pixel in a given state. Accordingly, for a given orientation of the polarizers, each pixel has a first and a second optically distinguishable state provided by the two stable states of the liquid crystal molecules in that pixel.

Figure 2:
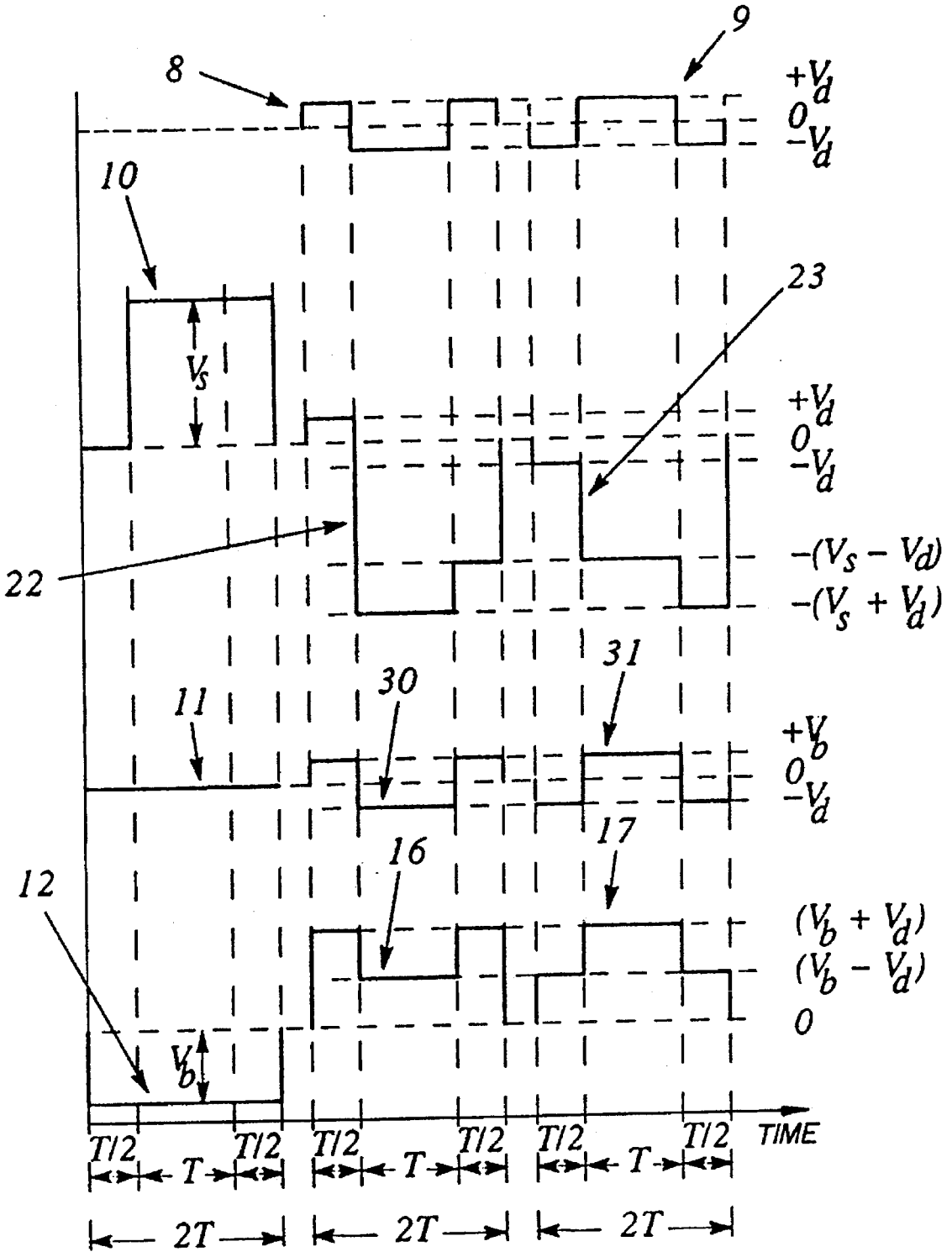
FIG. 2 shows various signals occurring in the apparatus of FIG. 1.

The signals produced by generator 5 are shown in FIG. 2. Generator 5 is constructed to generate a succession of bipolar data signals simultaneously on each column conductor 6, these data signals being synchronised with each other and each occupying a time 2T. These data signals each take one of two forms, denoted by reference numerals 8 and 9 respectively in FIG. 2. During each data period 2T generator 5 also generates a signal on each row conductor 7, these signals each taking one of three forms, denoted by reference numerals 10,11 and 12 respectively in FIG. 2. The result is that the pixels 2 are addressed with data in rows (although addressing in columns could equally well be employed, if desired).

If a given row is considered, then the complete addressing of the pixels 2 therein includes the steps of (a) applying the signal 12 to the corresponding row conductor 7 during at least one data period 2T while applying one of the data signals 8 and 9 to each of the column conductors and (b) applying the signal 10 to the corresponding row conductor 7 during a subsequent data period 2T while applying one of the data signals 8 and 9 to each of the column conductors. Which of the data signals 8 and 9 is applied to which of the conductors in step (b) determines the final state of each of the pixels 2 in the relevant row, as will now be explained.

Figure 3:
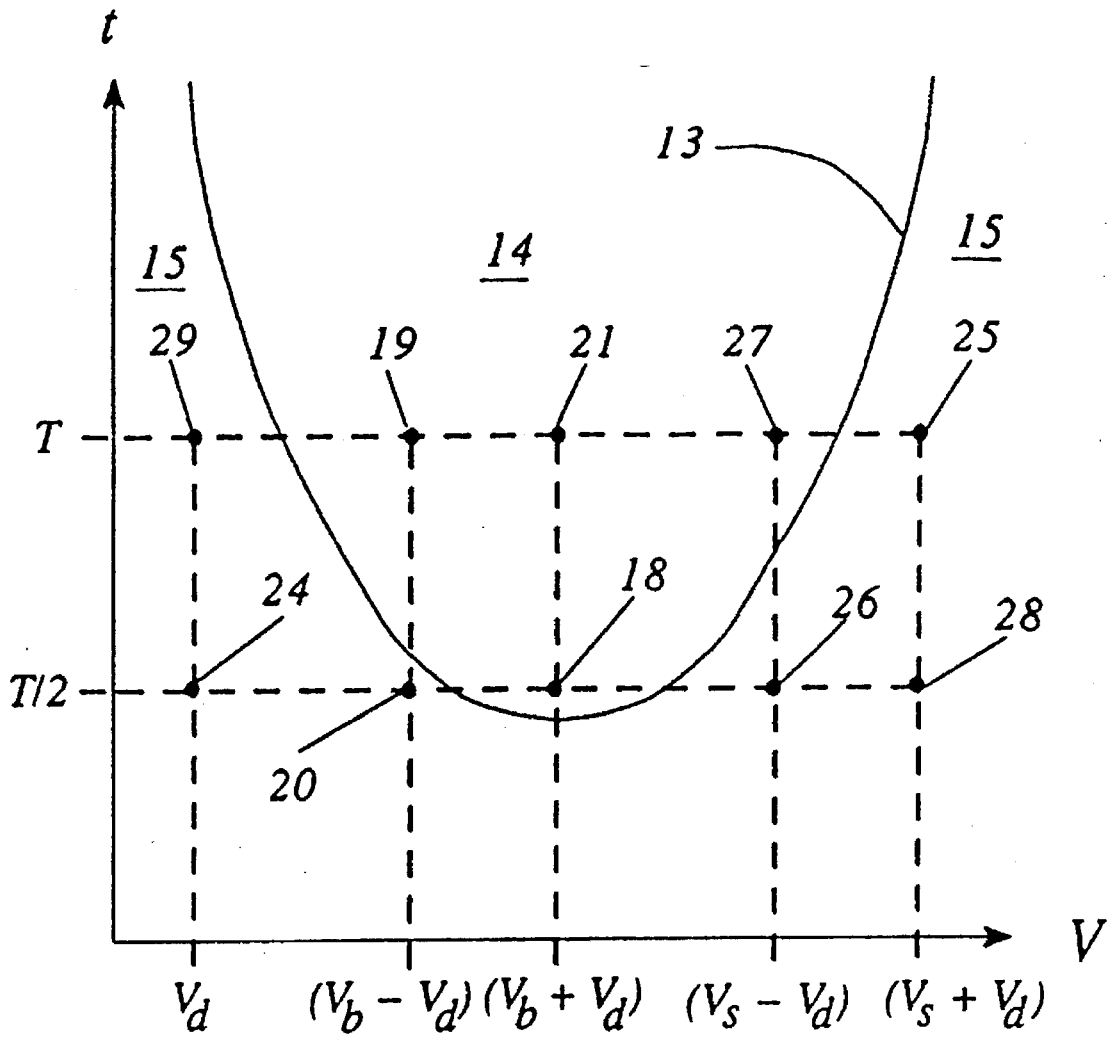
FIG. 3 illustrates how the states of pixels in the cell of FIG. 1 are set by means of the signals depicted in FIG. 2.

FIG. 3 of the drawings is a graph illustrating conditions necessary to obtain switching of a given pixel from one of its optically distinguishable states to the other. In this Figure the unidirectional voltage V applied across the pixel is plotted along the axis of abscissae and the time t for which this voltage is applied is plotted along the axis of ordinates. It is assumed that the polarity of the voltage V is such as to tend to switch the pixel from its current state to the other state. The graph shows a curve 13 having the general form of a "U". Points within the "U", i.e. within the region 14, correspond to actual switching of the state of the pixel, whereas points outside the "U", i.e. within the region 15, correspond to the pixel remaining in its current state. (It should be noted that the exact shape and position of the "U" depend upon various factors, such as temperature, the voltage conditions existing immediately prior to the time period t under consideration, etc). Examples of values for $V_d$, $(V_b-V_d)$, $(V_b+V_d)$, $(V_s-V_d)$ and $(V_s+V_d)$, c.f. FIG. 2, are shown along the V axis.

Referring once again to the complete addressing of the pixels 2 in a given row, in step (a) the (erase) signal 12 of FIG. 2 is applied to the corresponding row conductor 7 simultaneously with the application of the data signals 8 and 9 to each of the column conductors. Each pixel therefore has either the waveform 1 or the waveform 17 of FIG. 2 applied thereacross. The former case corresponds to points 18, 19 and 18 in FIG. 3 in succession, each of which lies within the region 14, and the latter case corresponds to points 20, 21 and 20 in FIG. 3 in succession, point 21 lying within the region 14. Thus all the pixels of the row which are not already in a first state (determined by the polarity of the waveforms 1 and 17 and in the present example an "off" state) are set to that state. Subsequently in step (b) the (strobe) signal 10 of FIG. 2 is applied to the corresponding row conductor 7 simultaneously with the application of one of the data signals 8 and 9 to each of the column conductors. The data signal 8 is applied to those column conductors which correspond to pixels which it required remain in the first state whereas the data signal 9 is applied to those conductors 6 which correspond to pixels which it is required are finally set to a second state (in the present example an "on" state). Thus the former pixels are supplied with the waveform 22 of FIG. 2 thereacross, whereas the latter pixels are supplied with the waveform 23 thereacross. Waveform 22 corresponds to points 24,25 and 2 of FIG. 3 in succession, which points all lie within the region 15, and waveform 23 corresponds to points 24, 27 and 28 of FIG. 3 in succession, point 27 lying within the region 14. Thus the pixels 2 which are supplied with the waveform 22 remain in the first or "off" state, whereas pixels which are supplied with the waveform 23 are switched to the second or "on" state, the polarity of waveform 23 being opposite to the polarity of the waveforms 1 and 17. The overall result is therefore that selected pixels (those whose column conductors are supplied with signal 8 in FIG. 2 in step (b) are set to or remain in the first or "off" state whereas other selected pixels (those whose column conductors are supplied with signal 9 in step (b)) are set to or remain in the second or "on" state.

Steps (a) and (b) are performed for all the rows of pixels, thereby setting each pixel of the cell 1 to the "on" or "off" state as required. This may be done in several ways. Obviously step (a) may be performed in respect of several rows simultaneously, if desired, whereas step (b) can be performed in respect of only one row at any given time. Those rows in respect of which neither step (a) nor step (b) is being performed in a given data period 2T are supplied at the relevant time with signal 11 of FIG. 2, i.e. with zero volts on the corresponding row conductors 7. This signal 11 combines with the data signals 8 or 9 at the relevant pixels to produce the waveforms 30 or 31 respectively in FIG. 2, these waveforms both corresponding with points 24,29 and 24 in FIG. 3 in succession. As both points 24 and 29 lie within the region 15 the states of the relevant pixels remain unchanged at these times.

If step (a) is performed in respect of several, for example two, rows simultaneously, it will be evident that each such step may occupy a corresponding number of adjacent data periods 2T, because the number of data periods basically required to perform this step in respect of all the rows will be reduced by a corresponding factor.

It might be assumed from the above description that exactly equivalent results would be obtained if the strobe signal 10 of FIG. 2 were to terminate three-quarters of the way through a data period 2T, rather than at the end thereof as described. This would mean that the final quarters of the waveforms 22 and 23 would have amplitudes $+V_d$ and $-V_d$ respectively (corresponding to point 24 in FIG. 3) rather than $-(V_s-V_d)$ and $-(V_s+V_d)$ respectively (corresponding to points 2 and 28 respectively in FIG. 3), all the points 24,26 and 28 lying within the region 15. This is true if the absolute value of the data period 2T is such as to position the point 27 well inside the region 14 of FIG. 3 as indicated. However, if this absolute value is reduced in an attempt to reduce the time required to address all the pixels 2 of the cell 1 this will have the effect of moving all the points 18–21 and 24–29 towards the v axis. This is immaterial as far as the points within the region 15 are concerned. However, those points within the region 14 will move towards the boundary 13 between the regions 14 and 15, and eventually cross it if the data period 2T is reduced sufficiently. It has, however, been found that a greater reduction in the absolute value of the data period 2T can be accommodated without jeopardising the state switching effect of the notional active (central) portion of waveform 23 of FIG. 2 (corresponding to point 27 in FIG. 3) if this central portion is succeeded by a further portion of greater amplitude as shown (corresponding to point 28 in FIG. 3) rather than by a further portion of lesser amplitude (corresponding to point 24 in FIG. 3) as would be obtained if the strobe signal 10 of FIG. 2 were to terminate three-quarters of the way through the relevant data period, even though both the points 28 and 24 lie within the region 15 of FIG. 3. In other words, a greater reduction in the data period 2T is possible without jeopardising the state switching required in step (b) if the strobe signal terminates after the active or central portion of the data signal 9 of FIG. 2 has ended rather than simultaneously with the end of this central portion.

It will be appreciated that a reduction in the absolute value of each data period 2T also tends to jeopardise the state switching effect of the erase waveforms 16 and 17 of FIG. 2 because the points 18, 19 and 21 of FIG. 3 will also move towards the boundary 13 between the regions 14 and 15. However, this effect can be ameliorated by, as mentioned hereinbefore, performing step (a) in respect of more than one row of pixels 2 simultaneously and arranging that each such step occupies a plurality of adjacent data periods 2T. This will mean that, when step (a) is performed in respect of any given pixel, that pixel will be supplied with one of the waveforms 16 and 17 of FIG. 2 immediately followed by at least one more of these waveforms so that the switching effect on the pixel will be given by a combination of two or more of these waveforms. Examination of the waveforms 16 and 17 will make it clear that such a combination will necessarily include a portion corresponding to point 21 in FIG. 3, which point is furthest from the boundary 13 as described. In fact amelioration of the said effect can be obtained even if the data periods of the plurality do not follow each other in direct succession, provided that they are reasonably close to each other, for example within three data periods of each other.

It will be appreciated that many modifications may be made to the embodiment described, within the scope of the invention as defined by the claims. For example, although preferred, the start of the strobe signal 10 of FIG. 2 need not necessarily coincide with the start of the second portion of the data signals 8 and 9; it may occur after these second portions have commenced (but before the end of these second portions) if desired. Moreover, the end of the strobe signal 10 need not necessarily coincide with the end of the third portion of the data signals 8 and 9 although, in accordance with the invention, it must occur after this third portion has commenced. Furthermore, the second portions of the data signals 8 and 9 do not necessarily occupy exactly half of a complete data period; they may, for example, occupy three-quarters of such a data period, the first and third portions then each occupying one-eighth of a data period and having double the amplitude of the second portion so that the total area under the first and third portions remains equal to the are under the second portion to maintain balance. As yet another example the amplitudes of the strobe and erase signals 10 and 12 of FIG. 2 are not necessarily constant throughout their duration; either or both may for example consist of a succession of pulses which may or may not have the same amplitude.

Although as described the first and second states of each pixel are "off" and "on" states respectively, it will be evident that the reverse may be the case, if desired. Moreover the "off" and "on" states need not be permanently stable; stability is required only for a time equal to the maximum time elapsing between the application of successive erase and strobe signals to the relevant pixel.

In one implementation of the method described with reference to FIGS. 1–3 in which step (a) was carried out for two rows at a time and occupied two adjacent data periods each time, various parameters etc. were as follows:

Liquid crystal material: Merck type 5014

Spacing between the electrodes 3 and 4 of each cell: 1.5 μm $V_d$: 10 V $V_s$: 30 V $V_b$: 15 V

2T: 184 μs

Temperature: 35 ° C.

I claim:

1. A method of addressing a matrix-type liquid crystal cell including liquid crystal material which is electrically settable to first and second stable optical states, the cell comprising a plurality of pixels which are defined by areas of overlap between members of a first set of electrodes on one side of the material and members of a second set of electrodes, which cross the first set, on the other side of the material, in which method the pixels are addressed in lines, the addressing of each line comprising (a) applying an erase signal having a given polarity to the corresponding electrode of the first set while applying at least one charge-balanced bipolar data signal to each electrode of the second set, thereby setting any pixel of the line which is not already in the first state to that state, and (b) subsequently applying a strobe signal having an opposite polarity to said given polarity to the corresponding electrode of the first set while applying a charge-balanced bipolar data signal to each electrode of the second set, thereby selectively setting to the second state any pixel of the line for which the data signal applied to the corresponding electrode of the second set has a given form, characterised in that when said data signal has said given form it comprises first, second and third successive portions in which it has said given polarity, said opposite polarity and said given polarity respectively, the amplitude of the second portion being less than the amplitude of the strobe signal, the end of the first portion coinciding with or occurring before the start of the strobe signal, the end of the second portion occurring after the start of the strobe signal, and the start of the third portion occurring before the end of the strobe signal.

2. A method as claimed in claim 1, wherein the ends of the third portion and the strobe signal coincide.

3. A method as claimed in claim 2, wherein said first, second and third portions have equal amplitude, the first and third portions each being of half the length of the second portion.

4. A method as claimed in claim 1, wherein said first, second and third portions have equal amplitude, the first and third portions each being of half the length of the second portion.

5. A method as claimed in claim 1 wherein, in step(a), an erase signal having the given polarity is applied to the corresponding electrode of the first set while applying a plurality of charge-balanced bipolar data signals to each electrode of the second set.

6. A method as claimed in claim 5, wherein said plurality of charge-balanced bipolar data signals follow each other in direct succession.

7. Optical modulator apparatus comprising a matrix-type liquid crystal cell and an addressing signal generator for addressing said cell, the cell including liquid crystal material which is electrically settable to first and second stable optical states, and comprising a plurality of pixels which are defined by areas of overlap between members of a first set of electrodes on one side of the material and members of a second set of electrodes, which cross the first set, on the other side of the material, the addressing signal generator having outputs coupled to the first and second sets of electrodes and being contructed to address the pixels in lines by each time (a) applying an erase signal having a given polarity to the corresponding electrode of the first set while applying at least one charge-balanced bipolar data signal to each electrode of the second set, thereby setting any pixel of the line which is not already in the first state to that state, and (b) subsequently applying a strobe signal having an opposite polarity to said given polarity to the corresponding electrode of the first set while applying a charge-balanced bipolar data signal to each electrode of the second set, thereby selectively setting to the second state any pixel of the line for which the data signal applied to the corresponding electrode of the second set has a given form, characterised in that the generator is constructed so that when said data signal has said given form it comprises first, second and third successive portions in which it has said given polarity, said opposite polarity and said given polarity respectively, the amplitude of the second portion being less than the amplitude of the strobe signal, the end of the first portion coinciding with or occurring before the start of the strobe signal, the end of the second portion occurring after the start of the strobe signal, and the start of the third portion occurring before the end of the strobe signal.

* * * * *